US008186176B2

(12) United States Patent
Kim

(10) Patent No.: US 8,186,176 B2
(45) Date of Patent: May 29, 2012

(54) ICE BANK FOR REFRIGERATOR

(75) Inventor: Hyeon-Jin Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 526 days.

(21) Appl. No.: 12/447,801

(22) PCT Filed: Oct. 30, 2007

(86) PCT No.: PCT/KR2007/005372

§ 371 (c)(1),
(2), (4) Date: Apr. 29, 2009

(87) PCT Pub. No.: WO2008/054106

PCT Pub. Date: May 8, 2008

(65) Prior Publication Data

US 2010/0058796 A1 Mar. 11, 2010

(30) Foreign Application Priority Data

Oct. 30, 2006 (KR) ..... 10-2006-0105813

(51) Int. Cl.
*F25C 5/18* (2006.01)

(52) U.S. Cl. ..... 62/344; 62/441

(58) Field of Classification Search ..... 62/344, 62/441, 353, 459, 340
See application file for complete search history.

(56) References Cited

U.S. PATENT DOCUMENTS 4,287,725 A * 9/1981 Hoenisch ..... 62/344
4,581,902 A * 4/1986 Starck et al. ..... 62/258
5,460,674 A * 10/1995 Chitouras ..... 156/94
6,050,079 A 4/2000 Durgin et al.
6,112,899 A * 9/2000 Zeringue ..... 206/541
6,148,624 A 11/2000 Bishop et al.
6,889,837 B2 * 5/2005 Soehnlen et al. ..... 206/459.5
6,952,936 B2 * 10/2005 Sannasi et al. ..... 62/344
7,014,391 B2 * 3/2006 Starheim et al. ..... 405/129.8
7,204,092 B2 * 4/2007 Azcarate Castrellon et al. . 62/72
7,410,230 B2 * 8/2008 Anderson et al. ..... 312/407
7,434,950 B2 * 10/2008 Whitney ..... 362/92
2001/0037657 A1 * 11/2001 Dasher et al. ..... 62/459
2002/0023594 A1 * 2/2002 Greene, Jr. ..... 119/496

FOREIGN PATENT DOCUMENTS

KR 20-0147718 Y1 6/1999
KR 20-0150820 Y1 7/1999

* cited by examiner

*Primary Examiner* — Mohammad Ali
(74) *Attorney, Agent, or Firm* — Birch, Stewart, Kolasch & Birch, LLP

(57) ABSTRACT

Disclosed is an ice bank for a refrigerator including: an inner case and an outer case forming one storage space having an opened top by being coupled to each other; and a coupling unit coupling the inner and outer cases to each other so that either one is relatively movable with respect to the other one so as for the capacity of the storage space to be variable. The ice bank for a refrigerator includes the inner and outer cases coupled to each other so that either one is relatively movable with respect to the other one, whereby accordingly the capacity of the ice bank is variable depending on the amount of ice that a customer needs, thereby enhancing the customer's product satisfaction. Further, when the customer needs a small amount of ice, the capacity of the ice bank can be reduced, accordingly enabling to effectively utilize the storage space of the refrigerator. Further, the ice bank stores as much ice as the customer needs, accordingly preventing deterioration of the ice resulting from long-time storage in the ice bank.

19 Claims, 10 Drawing Sheets

ICE BANK FOR REFRIGERATOR

TECHNICAL FIELD

The present invention relates to a refrigerator, and more particularly, to an ice bank for a refrigerator in which an interior capacity of the ice bank is variable so that the amount of ice which is made by an ice maker equipped in the refrigerator to be stored therein can be adjusted.

BACKGROUND ART

Refrigerators serve to store food items such as meat, fish, vegetable, fruit, beverage, etc. in a fresh state.

Generally, a refrigerator includes a refrigerator body having storage spaces such as a freezing chamber, a cooling chamber, a vegetable chamber, etc., a refrigeration cycle apparatus provided in the refrigerator body for maintaining the storage spaces at a pre-set temperature, and a door provided at one side of the refrigerator body for opening/closing the storage spaces.

Typically, the refrigerator has the freezing chamber disposed at an upper portion of the refrigerator body and the cooling chamber disposed at a lower portion thereof. But, recently, various types of refrigerator have been developed and made available to satisfy customers' needs for multi-functional and large-sized refrigerators.

For example, the available refrigerators include a type wherein the freezing chamber and the cooling chamber are disposed side by side, a type wherein the freezing chamber is disposed below the cooling chamber, and so on.

And, as the refrigerators have become multi-functional, various types of refrigerators are being made available equipped with an ice maker for making ice and an ice bank for storing the ice made by the ice maker in the storage space.

However, the ice bank for the refrigerator is fabricated to have a constant interior capacity so that the largest amount of ice that can be stored therein is limited.

Accordingly, the ice bank for the refrigerator may have problems as follows.

First, even though a storage amount of ice desired by the user is varied depending on the season or environment, the amount of ice that can be stored in the ice bank is fixed. Accordingly, it may be difficult to properly tailor to the customer's needs, thereby causing dissatisfaction.

Second, even when the customer needs a small amount of stored ice, the ice bank occupies the storage space of the refrigerator with a constant size, and accordingly, the storage space of the refrigerator may become unnecessarily small.

Third, even when the customer needs a small amount of stored ice, the amount of ice stored in the ice bank is constant, and accordingly, excess ice is stored in the ice bank for a long time, thereby deteriorating the ice.

DISCLOSURE OF THE INVENTION

Technical Problem

To solve the above problems, it is an object of the present invention to provide an ice bank for a refrigerator which has a variable capacity so as to adjust an amount of ice stored therein.

Technical Solution

To achieve these and other advantages and in accordance with an aspect of the present invention, there is provided an ice bank for a refrigerator comprising: an inner case and an outer case forming one storage space having an opened upper surface by being coupled to each other; and a coupling unit coupling the inner case and the outer case to each other so that either one is relatively movable with respect to the other one so as for the storage space to be variable.

Here, the inner case and the outer case may be implemented in a hexahedral shape having the upper surface and one lateral surface opened. Each of the opened lateral surfaces of the inner case and the outer case may be communicated with each other and the inner case is inserted into the outer case to be fixed thereto so that the inner case and the outer case can be relatively moved in a horizontal direction.

Alternately, the outer case may be implemented as first and second outer cases implemented in a hexahedral shape having the top and one end thereof opened. And, the inner case may be implemented in a hexahedral shape having the top and two corresponding ends thereof opened, and the opened ends of the inner case may be inserted into the opened ends of the first and second outer cases, respectively, so as to be coupled to each other and form one storage space.

Meanwhile, the coupling unit may comprise: a guide slot formed in one or both side surfaces of the inner case or inner lateral surfaces of the outer case in a horizontal direction; and guide protrusions formed at the other one and inserted into the guide slot for moving along the guide slot.

Alternatively, the coupling unit may comprise: a guide slot formed in one of an outer bottom surface of the inner case or an inner bottom surface of the outer case in parallel with a moving direction of the inner case; a guide protrusion formed at the other one and moving along the guide slot; and support flanges inwardly protruding from upper ends of both sides of the outer case for supporting the inner case.

Effect of the Invention

The present invention includes the inner case and outer cases coupled to each other so that either one thereof is relatively movable with respect to the other, whereby accordingly, the capacity of the ice bank can be varied depending on the amount of ice that a customer requires, thereby enhancing the customer's product satisfaction.

Further, in accordance with the present invention, when the customer needs a small amount of ice, the capacity of the ice bank can be reduced, thereby accordingly enabling to effectively utilize the storage space of the refrigerator.

Further, in accordance with the present invention, the ice bank can store as much ice as the customer needs, accordingly avoiding deterioration of the ice resulting from long-time storage of the ice in the ice bank.

MODES FOR CARRYING OUT THE PREFERRED EMBODIMENTS

Hereinafter, the present invention will be described in detail with reference to accompanying drawings.

Figure 1:
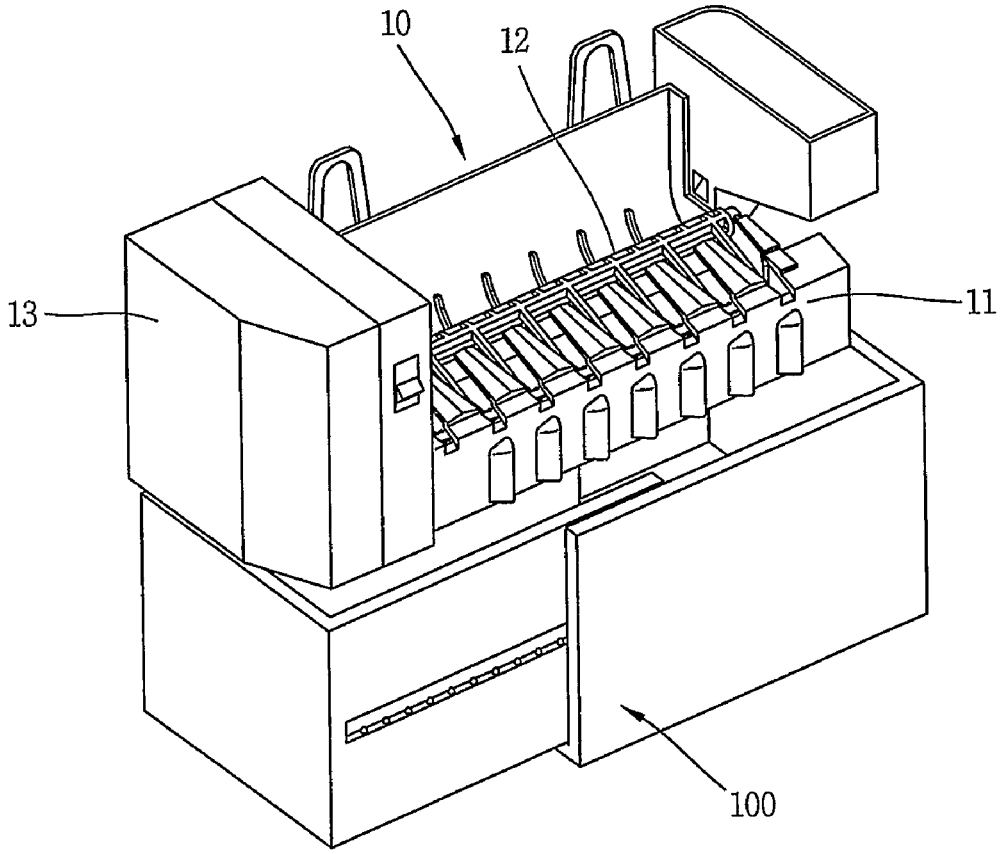
FIG. 1 is a perspective view showing an ice maker and an ice bank for a refrigerator in accordance with a first embodiment of the present invention.

FIG. 1 is a perspective view showing an ice maker and an ice bank for a refrigerator in accordance with a first embodiment of the present invention.

As shown, an ice maker 10 disposed at one side of a storage space (not shown) of a refrigerator includes an ice tray 11 for making ice, an ejector 12 for discharging the ice made in the ice tray 11 to the outside, and a driving apparatus 13 for driving the ejector 12.

Further, a heater (not shown) implemented as thermal rays, etc. may be provided at a lower surface of the ice tray 11 so as to easily separate the ice from the ice tray 11.

Meanwhile, an ice bank 100 in accordance with the embodiment is disposed below the ice maker 10 so as to store the ice discharged from the ice maker 10.

The ice bank 100 is removably installed in the storage space of the refrigerator and has an opened top to receive the ice made in the ice maker 10.

Further, the ice bank 100 has an inner capacity that can be adjusted according to a user's choice. The configuration will be described in detail hereafter.

Figure 2:
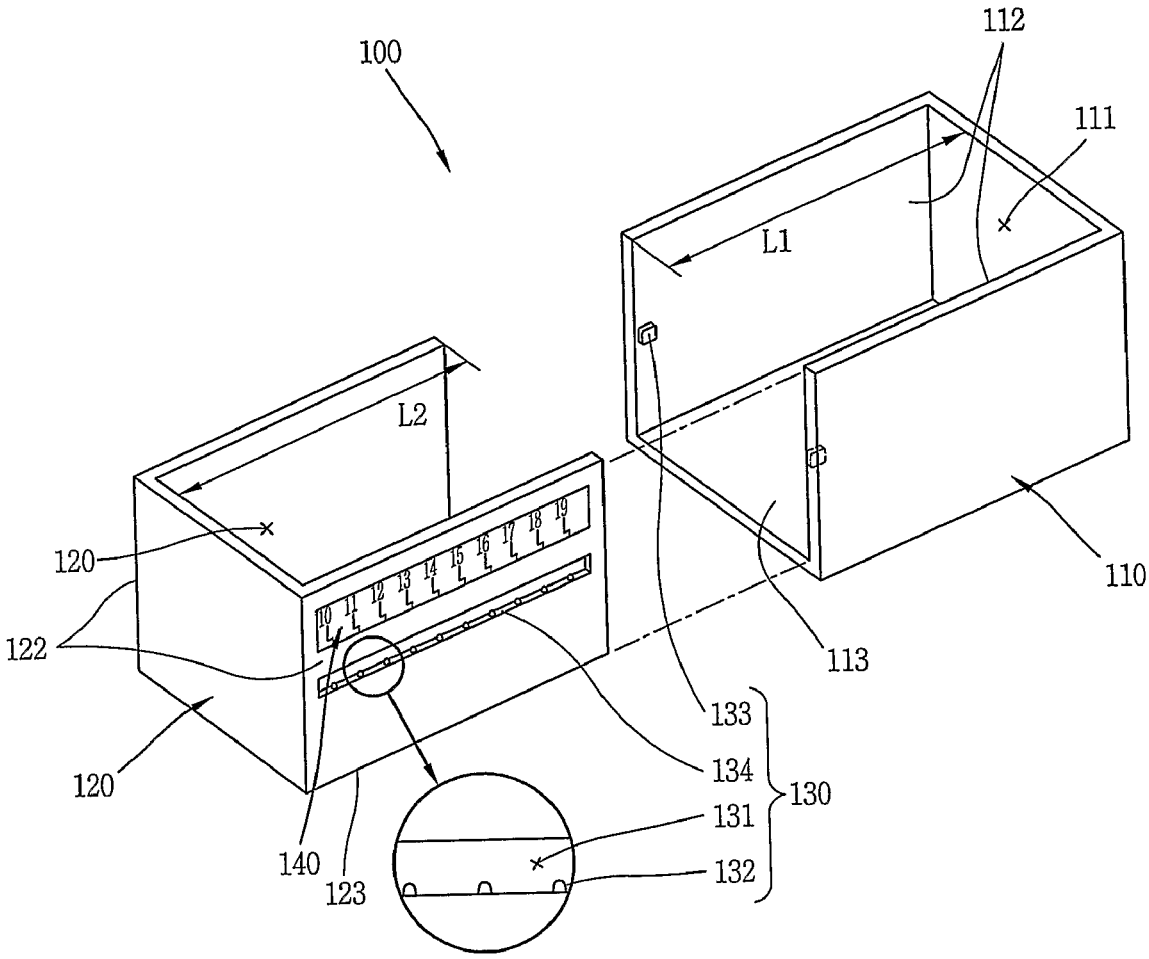
FIG. 2 is an exploded perspective view showing the ice bank for a refrigerator in accordance with the first embodiment of the present invention.
Figure 3:
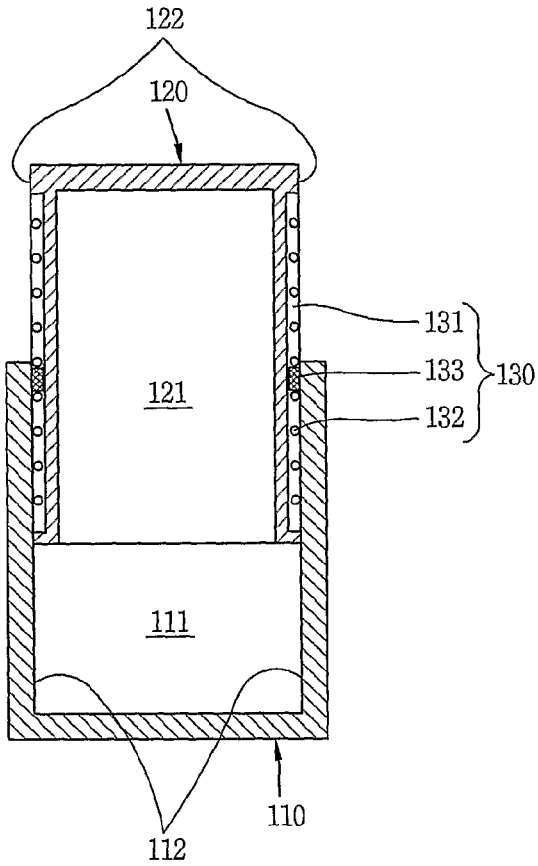
FIG. 3 is a horizontal sectional view showing a coupled state of the ice bank for a refrigerator in accordance with the first embodiment of the present invention.
Figure 4:
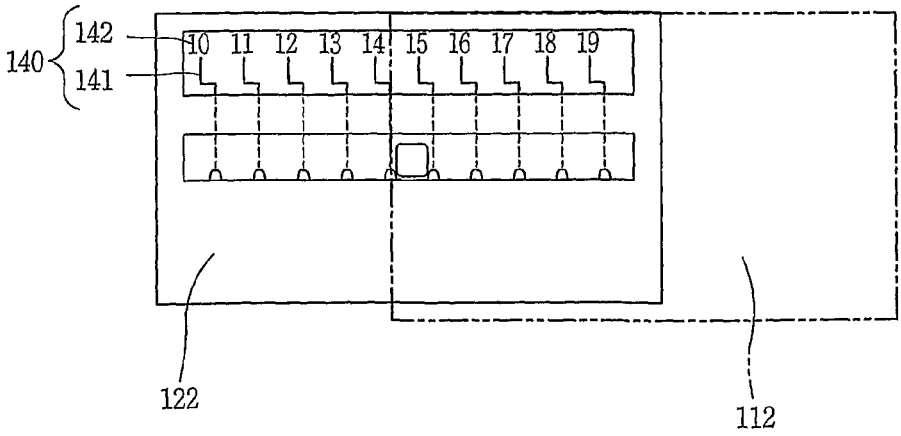
FIG. 4 is a diagram showing a lateral surface of an inner case in FIG. 2.

FIG. 2 is an exploded perspective view showing the ice bank for a refrigerator in accordance with the first embodiment of the present invention, FIG. 3 is a horizontal sectional view showing a coupled state of the ice bank for a refrigerator in accordance with the first embodiment of the present invention, and FIG. 4 shows a side surface of an inner case in FIG. 2.

As shown, the ice bank 100 in accordance with the embodiment includes an outer case 110, an inner case 120 and a coupling unit 130 for coupling the above cases to each other.

The outer case 110 is implemented in a hexahedral shape having the top surface and one end thereof opened, and disposes an ice storage space 111 therein.

Like the outer case 110, the inner case 120 is implemented in a hexahedral shape having its top surface and one end thereof opened, and disposes an ice storage space 121 therein.

The inner case 120 is inserted into the outer case 110 to form one storage space. Thus, the size of the inner case 120 is smaller than that of the outer case 110.

Particularly, it is preferable that the inner case 120 is formed to be inserted into the outer case 110 in the state that both outer side surfaces 122 and the outer bottom surface 123 of the inner case 120 are adhered to both inner side surfaces 112 and the inner bottom surface 113 of the outer case 110.

Further, the inner case 120 is inserted into the outer case 110 so that each of the opened ends of the inner case 120 and the outer case 110 are communicated with each other, that is, the inner space 121 of the inner case 120 and the inner space 111 of the outer case 110 are communicated with each other.

Accordingly, the inner case 120 and the outer case 110 may form one storage space.

Further, in the ice bank 100 in accordance with the embodiment, the inner case 120 and the outer case 110 are coupled to each other so as to be relatively movable in a horizontal direction so that the capacity of the inner storage space may be varied.

That is, the capacity of the ice bank 100 in accordance with the embodiment is variable according to the overlapped length of both sides 112 of the outer case 110 with both sides 122 of the inner case 120.

Therefore, in order to maximize the range of the variable capacity of the ice bank 100, the length L1 of both sides 112 of the outer case 110 in the horizontal direction is preferably made to be same as the length L2 of both sides 122 of the inner case 120 in the horizontal direction.

Because the minimum capacity that can be obtained by overlapping two cases having different capacities from each other is the same as the capacity of the larger case or greater, and the maximum capacity is the same as the capacity of both cases or less, therefore, in order for the difference between the maximum capacity and the minimum capacity to be greatest, the two cases should have the same capacity as each other.

Accordingly, the ice bank 100 has the minimum capacity in the state that both sides 112 of the outer case 110 and both sides 122 of the inner case 120 are completely overlapped with each other, which is the same as the capacity of the inner space 121 of the inner case 120. And, the ice bank 100 has the maximum capacity in the state that both sides 112 of the outer case 110 and both sides of the inner case 120 are completely separated from each other. Here, the size is implemented by adding the capacity of the inner space 121 of the inner case 120 to that of the inner space 111 of the outer case 110.

Meanwhile, the ice bank 100 in accordance with the embodiment includes the coupling unit 130 for coupling the outer case 110 and the inner case 120 to each other.

Accordingly, the inner case 120 and the outer case 110 are coupled to be movable in a horizontal direction relative to each other.

Hereafter, the coupling unit 130 will be described in detail.

As shown in FIGS. 2 and 3, the coupling unit 130 includes a guide slot 131 and a guide protrusion 133 inserted into the guide slot 131 for moving along the guide slot 131.

A guide slot 131 is formed in each outer side 122 of the inner case 120 being extended in a lengthwise direction of the both sides 122.

A guide protrusion 133 is provided on each inner side 112 of the outer case 110, i.e., at the front end of each side 112 facing the opened end of the outer case 110.

Accordingly, either one of the outer case 110 and the inner case 120 is relatively movable with respect to the other one, and the inner case 120 and the outer case 110 maintain their coupled state to each other.

That is, if either one of the outer case 110 and the inner case 120 is relatively moved with respect to the other one, the guide protrusions 133 being inserted into the guide slots 131 move along the guide slots 131.

Meanwhile, a plurality of stopping protrusions 132 are provided on at least one of both side surfaces 134 forming the guide slots 131.

The stopping protrusions 132 are spaced from each other at an interval corresponding to the length in the horizontal direction of the guide protrusion 133.

Accordingly, when either one of the outer case 110 and the inner case 120 is relatively moved with respect to the other one, the outer case 110 or the inner case 120 may be moved by each pre-set distance.

That is, as the guide protrusions 133 consecutively pass over the stopping protrusions 132, the outer case 110 and the inner case 120 are moved by each pre-set distance.

Meanwhile, as shown in FIG. 4, a storage capacity representing unit 140 for representing the variable capacities of the ice bank 100 is provided on both outer side surfaces 122 of the inner case 120.

The storage capacity representing unit 140 includes numeric value representing portion 142 for representing the storage capacity by numeric values and an indicating portion 141 for indicating the relative position of the outer case 110 and the inner case 120 corresponding to the storage capacity.

The indicating portion 141 is implemented as scales etc. on one surface of the inner case 120, corresponding to the number of the stopping protrusions 132.

The numeric value representing portion 142 is implemented for representing the capacity of the ice bank 100 in a numerical manner, corresponding to each scale division of the indicating portion 141, expressed in volume units such as liters L, etc.

The procedure for checking the capacity of the ice bank 100 by the storage capacity representing unit 140 will be described as follows.

As the capacity of the ice bank 100 is varied, the overlapping degree between the sides 122 of the inner case 120 and the sides 112 of the outer case 110 is varied step by step, and the front ends 113 of the sides 112 of the outer case 100 corresponds to any one scale of the indicating portion 141 at every step. Here, the numeric value of the numeric value representing portion 142 corresponding to the scale corresponds to the capacity of the ice bank 100.

Meanwhile, in FIGS. 2 to 4, the guide protrusions 133 and the guide slots 131 are shown provided at both inner side surfaces 112 of the outer case 110 and both outer side surfaces 122 of the inner case 120, respectively, but are not limited thereto. It is possible to provide the guide protrusions 133 at both outer side surfaces 122 of the inner case 120 and the guide slots 131 in both inner side surfaces 112 of the outer case 110.

Hereafter, the procedure whereby the capacity of the ice bank for a refrigerator in accordance with the first embodiment of the present invention is varied will be described with reference to FIG. 3.

First, when the user needs a small amount of ice, the ice bank 100 is used in the state that the inner space 111 of the outer case 110 and the inner space 121 of the inner case 120 are completely overlapped with each other. Thus, the capacity of the ice bank 100 comes to coincide with the inner space 121 of the inner case 120. Here, front end portions of the guide protrusions 133 are adhered to the front end portions of the guide slots 131.

In such state, in order to increase the capacity of the ice bank 100, the outer case 110 is drawn back, i.e., downwardly in FIG. 3, with respect to the inner case 120. Thus, the guide protrusions 133 consecutively pass over the stopping protrusions 132 in the guide slots 131, as the outer case 110 is moved with respect to the inner case 120 by the distances of the adjacent stopping protrusions 132. Eventually, the ice bank 100 has the substantially increased capacity by the inner space 111 of the outer case 110 which has been increased corresponding to the moving distance of the outer case 110 with respect to the inner case 120.

Meanwhile, in order to further increase the capacity of the ice bank 100, the inner case 120 is continuously drawn backwardly, i.e., downwardly in FIG. 3. And, when the rear end portions of the guide protrusions 133 are adhered to the rear end portions of the guide slots 131, the inner case 120 is not movable any further. Here, the capacity of the ice bank 100 corresponds to the sum of the inner space 111 of the outer case 110 and the inner space 121 of the inner case 120.

Next, the ice bank for a refrigerator in accordance with a second embodiment of the present invention will be described in detail with reference to the accompanying drawings. Detailed description about configurations of the embodiment which are the same as those of the first embodiment will be omitted.

Figure 5:
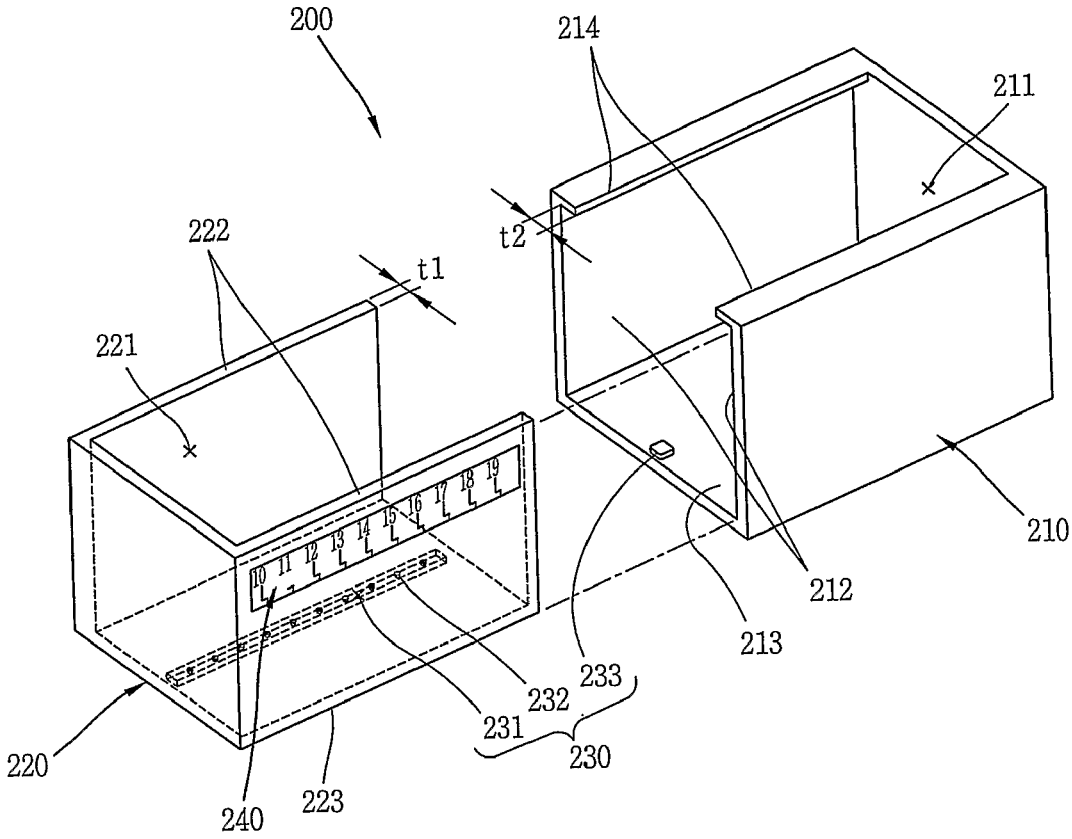
FIG. 5 is a perspective view showing an ice bank for a refrigerator in accordance with a second embodiment of the present invention.
Figure 6:
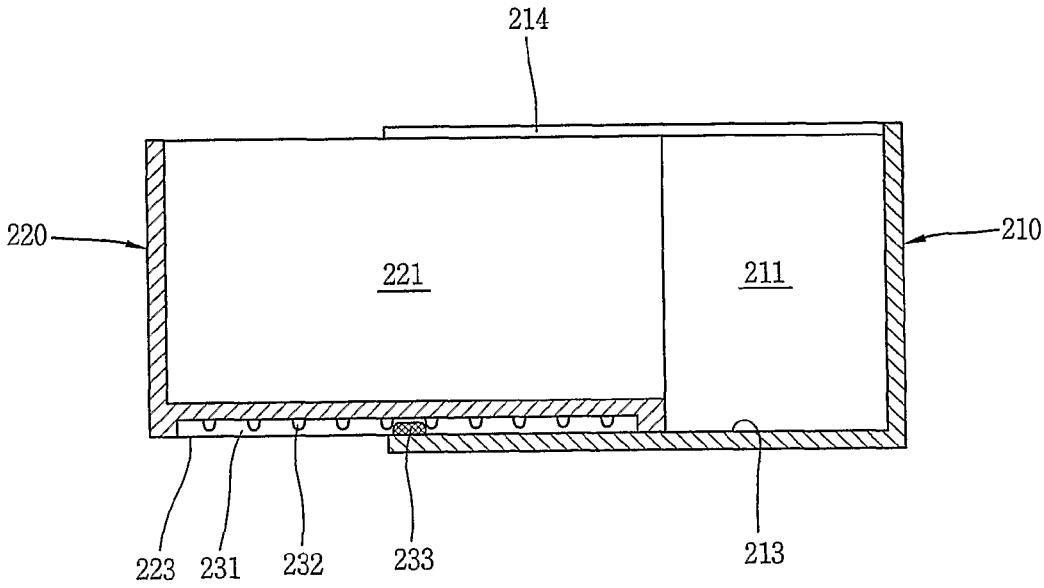
FIG. 6 is a vertical sectional view showing a coupled state of the ice bank for a refrigerator in accordance with the second embodiment of the present invention.

FIG. 5 is a perspective view showing the ice bank for the refrigerator in accordance with the second embodiment of the present invention, and FIG. 6 is a vertical sectional view showing the coupled state of the ice bank for a refrigerator in accordance with the second embodiment of the present invention.

As shown, the ice bank 200 for a refrigerator in accordance with this embodiment includes an outer case 210, an inner case 220 and a coupling unit 230 for coupling the above cases to each other The outer case 210 is implemented in a hexahedral shape having the top and one end thereof opened, and disposes an ice storage space 211 therein.

Like the outer case 210, the inner case 220 is implemented in a hexahedral shape having the top and one end thereof opened, and disposes an ice storage space 221 therewithin.

The inner case 220 is inserted into the outer case 210 to form one contiguous storage space.

Meanwhile, the coupling unit 230 includes a guide slot 231 and a guide protrusion 233 inserted into the guide slot 231 for moving along the guide slot 231.

The guide slot 231 is formed in an outer bottom surface 223 of the inner case 220 being extended in the lengthwise direction of the inner case 220.

The guide protrusion 233 is provided at an inner bottom surface 213 of the outer case 210, i.e., at the front end of the bottom surface 213 contacting with the opened end of the outer case 210.

Further, support flanges 214 are respectively formed inwardly protruded from the upper ends of both side walls 212 adjacent the opened top of the outer case 210.

Meanwhile, a plurality of stopping protrusions 232 are provided on at least one of the side surfaces of the guide slot 231.

The stopping protrusions 232 are spaced from each other with an interval corresponding to the length of the guide protrusion 233 in the horizontal direction.

Further, a storage capacity representing unit 240 for representing the variable capacities of the ice bank 200 may be provided at both outer side surfaces 222 of the inner case 220.

Accordingly, when either one of the outer case 210 or the inner case 220 is relatively moved with respect to the other one, the outer case 210 or the inner case 220 may be moved by each pre-set distance, thereby being capable of varying the capacity of the ice bank 200.

Further, when varying the capacity of the ice bank 200, the guide slot 231 may not be exposed, accordingly enabling to increase the user's product satisfaction by the neat appearance and to reduce the manufacturing cost by forming of only one guide slot 231.

The procedure whereby the capacity of the ice bank for a refrigerator in accordance with the second embodiment of the present invention is varied is similar to that of the first embodiment as abovementioned, and therefore will be omitted.

Next, the ice bank for a refrigerator in accordance with a third embodiment of the present invention will be described in detail with reference to the accompanying drawings. Detailed description about configurations of the embodiment which are the same as those of the first embodiment will be omitted.

Figure 7:
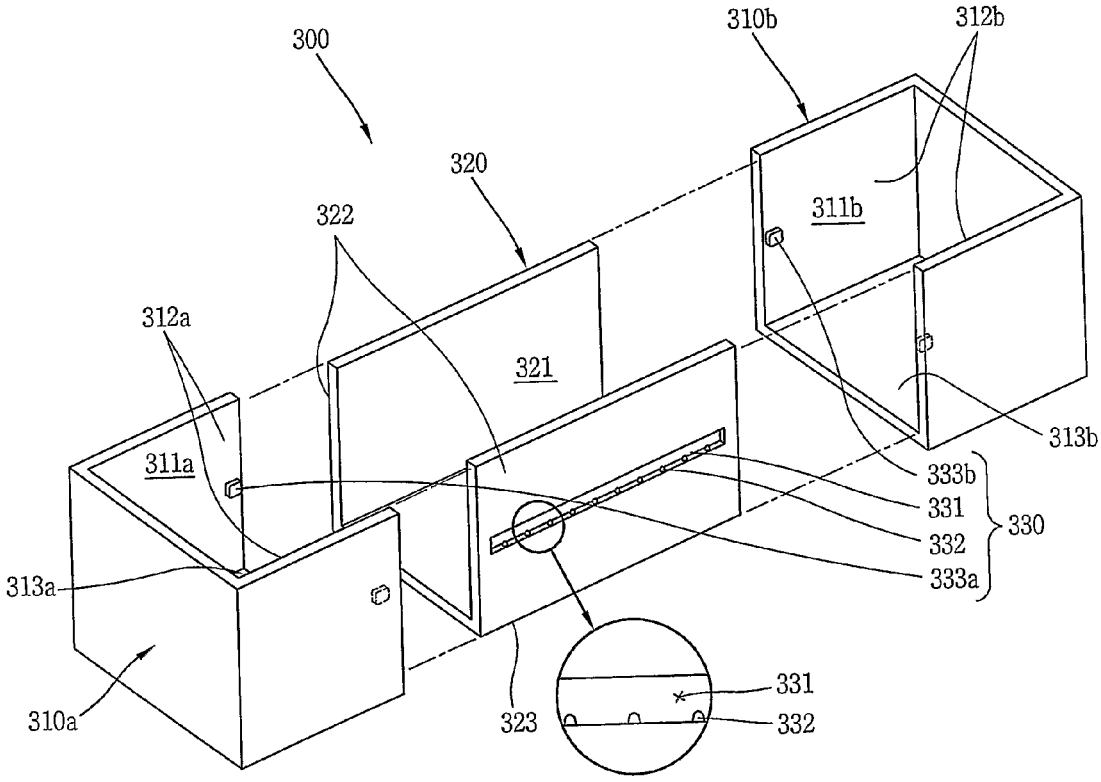
FIG. 7 is an exploded perspective view showing an ice bank for a refrigerator in accordance with a third embodiment of the present invention.
Figure 8:
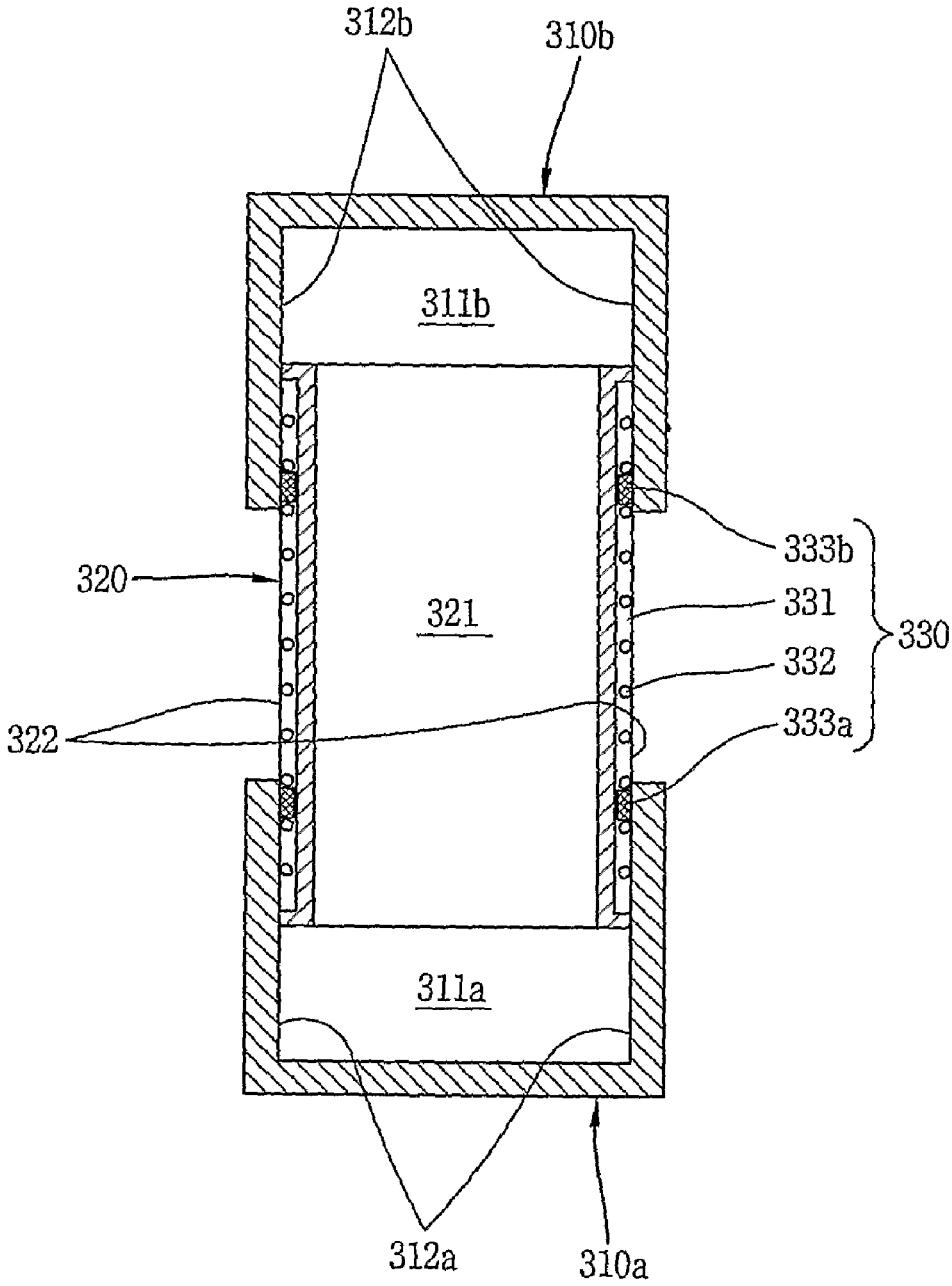
FIG. 8 is a horizontal sectional view showing a coupled state of the ice bank for a refrigerator in accordance with the third embodiment of the present invention.

FIG. 7 is an exploded perspective view showing the ice bank for a refrigerator in accordance with the third embodiment of the present invention, and FIG. 8 is a horizontal sectional view showing a coupled state of the ice bank for a refrigerator in accordance with the third embodiment of the present invention.

As shown, the ice bank 300 for a refrigerator in accordance with this embodiment includes first and second outer cases 310*a*, 310*b*, an inner case 320, and a coupling unit 330 for coupling the above cases to each other.

The first and second outer cases 310*a*, 310*b* are implemented in a hexahedral shape having the top and one end thereof opened, respectively.

Specific storage spaces 311*a*, 311*b* for storing ice are disposed in the first and second outer cases 310*a*, 310*b*, respectively.

The inner case 320 is implemented in a hexahedral shape having the top and two ends thereof opened.

A specific storage space 321 communicating with the storage spaces 311*a*, 311*b* in the first and second outer cases 310*a*, 310*b* is disposed in the inner case 320.

Accordingly, the first and second outer cases 310*a*, 310*b* are disposed in the state that the inner case 320 is inserted into the storage spaces 311*a*, 311*b* in the first and second outer cases 310*a*, 310*b* so that the first and second outer cases 310*a*, 310*b* are movable to become more distant or closer with respect to the inner case 320.

Further, the first and second outer cases 310*a*, 310*b* are movable with respect to the inner case 320 in a range from where each of the storage spaces 311*a*, 311*b*, 321 is completely overlapped with each other, to where each of the storage spaces 311, 311*b*, 321 is completely separated from each other.

Thus, preferably, the total capacity of the storage spaces 311*a*, 311*b* of the first and second outer cases 310*a*, 310*b* is the same as the capacity of the storage space 321 of the inner case 320.

Here, in the state that the storage spaces 311*a*, 311*b*, 321 of the first and second outer cases 310*a*, 310*b* and the inner case 320 are completely overlapped with each other, the ice bank 300 has a capacity which is same as that of the storage space 321 of the inner case 320.

And, in the state that the storage spaces 311*a*, 311*b*, 321 of the first and second outer cases 310*a*, 310*b* and the inner case 320 are completely separated from each other, the ice bank 300 has a capacity corresponding to the total capacity of the storage spaces 311*a*, 311*b* of the first and second outer cases 310*a*, 310*b* plus the storage space 321 of the inner case 320.

Meanwhile, the coupling unit 330 in accordance with this embodiment includes guide slots 331 and guide protrusions 333*a*, 333*b* inserted into the guide slots 331 for moving along the guide slots 331.

The guide slots 331 are respectively provided in both outer side surfaces 322 of the inner case 320 in the horizontal direction.

The guide protrusions 333*a*, 333*b* are provided on both inner side surfaces 312*a* 312*b* of the first and second outer cases 310*a*, 310*b*, i.e., at the front ends contacting with the opened ends of the first and second outer cases 310*a*, 310*b*.

The guide protrusions 333*a*, 333*b* and the guide slots 331 operate to guide the first and second outer cases 310*a*, 310*b* so as to be movable with respect to the inner case 320.

Upon moving the first and second outer cases 310*a*, 310*b* in a direction to be distant or close to each other with respect to the inner case 320, the guide protrusions 333*a*, 333*b* are moved along the guide slots 331 therein.

A plurality of stopping protrusions 332 are provided at one of the side surfaces of the guide slots 331.

The stopping protrusions 332 are spaced from each other by an interval corresponding to the length of the guide protrusions 333*a*, 333*b*.

As for the stopping protrusions 332, when the first and second outer cases 310*a*, 310*b* are moved with respect to the inner case 320, the guide protrusions 333*a*, 333*b* are consecutively stopped by the stopping protrusions 332, and accordingly the first and second outer cases 310*a*, 310*b* are moved by each pre-set distance.

Preferably, the stopping protrusions 332 are implemented as members that are elastically restored so as for the guide protrusions 333*a*, 333*b* to consecutively pass over the stopping protrusions 332.

Meanwhile, as described in detail in the first embodiment, a storage capacity representing unit 340 for representing the variable capacities of the ice bank 300 may be provided at both outer side surfaces 322 of the inner case 320.

The procedure whereby the capacity of the ice bank for a refrigerator in accordance with the third embodiment of the present invention is varied is similar to that of the first embodiment abovementioned, therefore will be omitted.

Next, an ice bank for a refrigerator in accordance with a fourth embodiment of the present invention will be described in detail with reference to the accompanying drawings. Detailed description about configurations of this embodiment which are the same as those of the first embodiment will be omitted.

Figure 9:
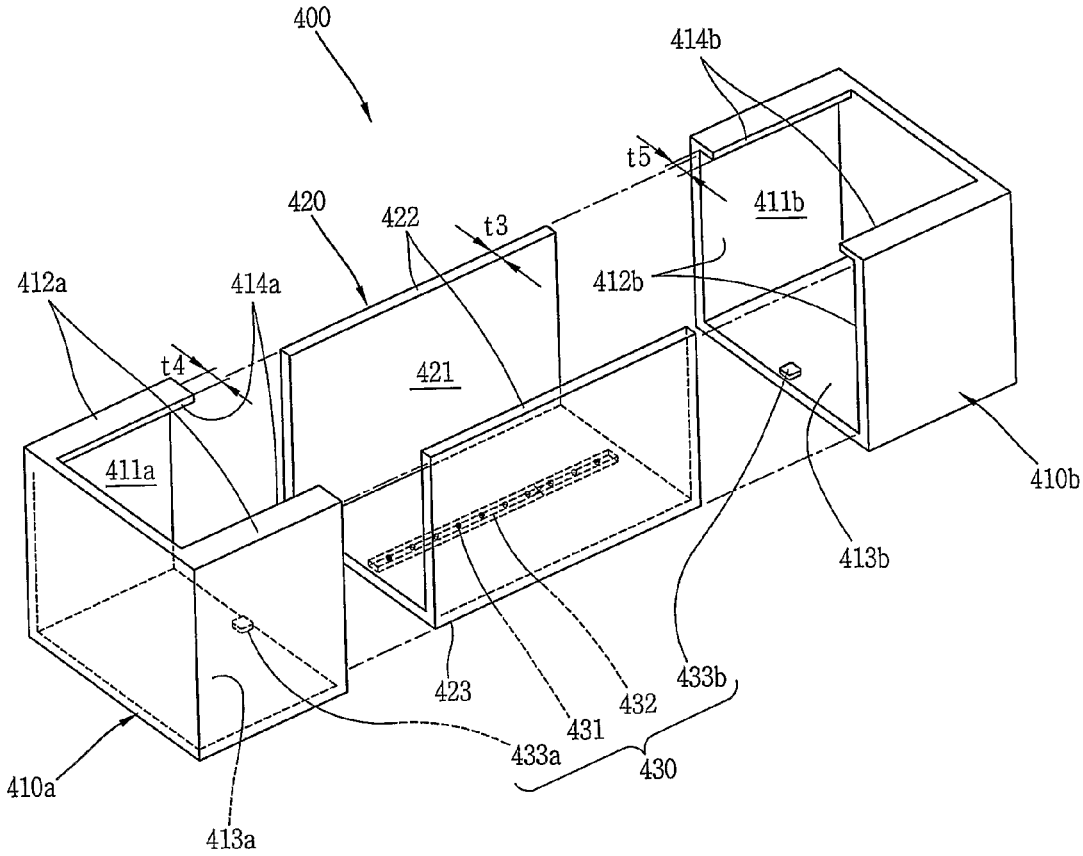
FIG. 9 is a perspective view showing an ice bank for a refrigerator in accordance with a fourth embodiment of the present invention.
Figure 10:
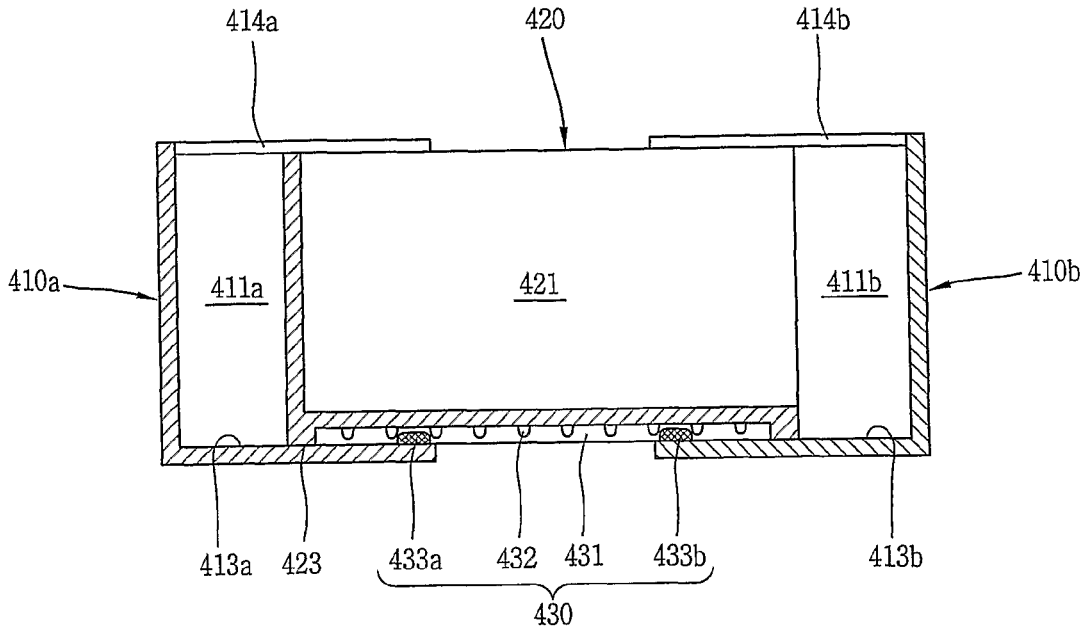
FIG. 10 is a vertical sectional view showing a coupled state of the ice bank for a refrigerator in accordance with the fourth embodiment of the present invention.

FIG. 9 is a perspective view showing the ice bank for a refrigerator in accordance with the fourth embodiment of the present invention, and FIG. 10 is a horizontal sectional view showing a coupled state of the ice bank for a refrigerator in accordance with the fourth embodiment of the present invention.

As shown, the ice bank 400 for a refrigerator in accordance with this embodiment includes first and second outer cases 410*a*, 410*b*, an inner case 420, and a coupling unit 430 for coupling the above cases to each other.

The first and second outer cases 410*a*, 410*b* are implemented in a hexahedral shape having the top and one end thereof opened, respectively.

Specific storage spaces 411*a*, 411*b* for storing ice are disposed in the first and second outer cases 410*a*, 410*b*, respectively.

The inner case 420 is implemented in a hexahedral shape having the top and two ends thereof opened.

A specific storage space 421 communicated with the storage spaces 411*a*, 411*b* in the first and second outer cases 410*a*, 410*b* is disposed in the inner case 420.

Accordingly, the inner case 420 is inserted into the storage spaces 411*a*, 411*b* in the first and second outer cases 410*a*,

410*b* so that the first and second outer cases 410*a*, 410*b* are movable to become more distant or closer to each other with respect to the inner case 420.

Meanwhile, the coupling unit 430 in accordance with this embodiment includes a guide slot 431 and guide protrusions 433*a*, 433*b* inserted into the guide slot 431 for moving along the guide slot 431.

The guide slot 431 is provided in an outer bottom surface 423 of the inner case 420 being extended in the lengthwise direction of the inner case 420.

The guide protrusions 433*a*, 433*b* are respectively provided on the inner bottom surfaces 413*a*, 413*b* of the first and second outer cases 410*a*, 410*b*, i.e., at the front ends thereof adjacent the opened ends of the first and second outer cases 410*a*, 410*b*.

Further, inwardly protruding support flanges 414*a*, 414*b* are respectively formed at upper ends of both sides 412*a*, 412*b* adjacent the opened tops of the first and second outer cases 410*a*, 410*b*.

Meanwhile, a plurality of stopping protrusions 432 are provided on the inner side of the guide slot 431 in the lengthwise direction thereof.

The stopping protrusions 432 are spaced from each other by the length of the guide protrusions 433*a*, 433*b*.

As for the stopping protrusions 432, when the first and second outer cases 410*a*, 410*b* are moved with respect to the inner case 420, the guide protrusions 433*a*, 433*b* are consecutively stopped by the stopping protrusions 432, and accordingly the first and second outer cases 410*a*, 410*b* are moved by each pre-set distance.

Meanwhile, as described in detail in the first embodiment, a storage capacity representing unit 440 for representing the variable capacities of the ice bank 400 may be provided at both outer side surfaces 422 of the inner case 420.

In the ice bank 400 in accordance with this embodiment as configured above, when the capacity of the ice bank 400 is varied, the guide slot 431 is not exposed, and accordingly, the customer's product satisfaction can be increased by the neat appearance. Further, only one guide slot 431 is formed, thereby enabling to reduce the manufacturing cost.

Further, the procedure whereby the capacity of the ice bank for a refrigerator in accordance with the fourth embodiment of the present invention is varied is similar to that of the first embodiment as abovementioned, and therefore will be omitted.

Next, one variation of the coupling unit of the ice bank for a refrigerator of the present invention will be described in detail with reference to the accompanying drawings.

Figure 11:
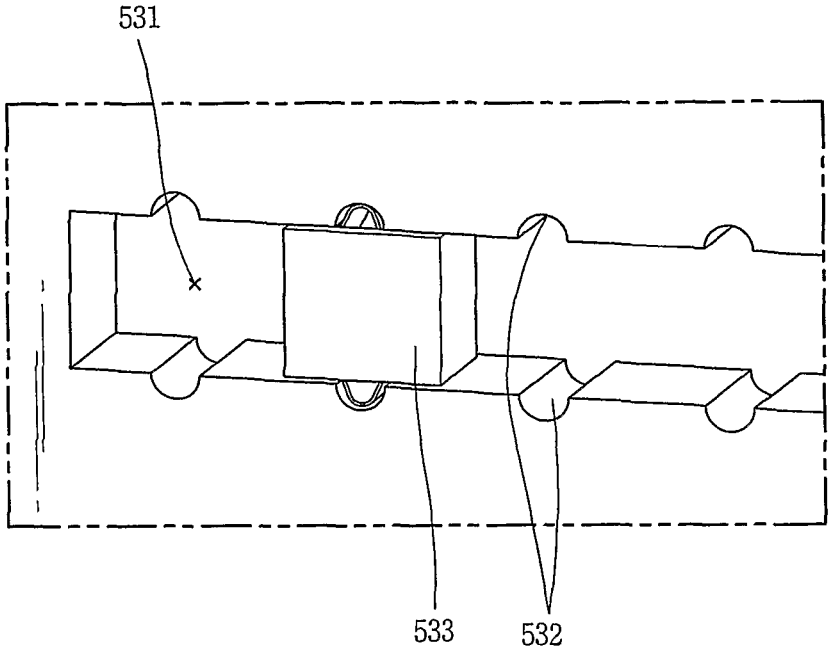
FIG. 11 is a diagram showing one variation of a coupling unit of the ice bank for a refrigerator in accordance with the first embodiment of the present invention.
Figure 12:
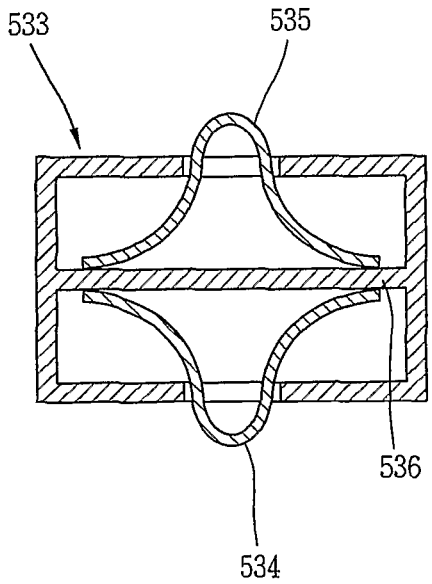
FIG. 12 is a sectional view showing an internal configuration of a guide protrusion in FIG. 11.

FIG. 11 is a diagram showing one variation of the coupling unit of the ice bank for the refrigerator of the present invention, and FIG. 12 is a sectional view showing an internal configuration of a guide protrusion in FIG. 11.

As shown, a coupling unit 530 of the ice bank for a refrigerator in accordance with the present invention includes a guide slot 531 and a guide protrusion 533. A plurality of stopping recesses 532 spaced from each other by a constant interval in the lengthwise direction of the guide slot 531 are provided along the inner sides of the guide slot 531. And, a stopping protrusion 535 is provided at least one of both side surfaces of the guide protrusion 533 to be protruded therefrom.

Here, preferably, the stopping protrusion 535 is implemented as an elastic member such as a plate spring, etc..

Further, preferably, the guide protrusion 535 having a hexahedral shape which is hollow therein is provided with a protrusion hole 534 so that a part of the stopping protrusion 535 can be protruded, and has a support portion 536 therein so as to support the stopping protrusion 535.

Accordingly, the stopping protrusion 535 provided at the guide protrusion 533 is step by step stopped in the stopping recesses 532 formed at the guide slot 531, thereby being capable of varying the capacity of the ice bank for the refrigerator step by step.

It will be apparent that the variation of the coupling unit can be applied any one of the first to fourth embodiments in accordance with the present invention.

As aforementioned, specific embodiments of the present invention have been shown and described. But, as the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. An ice bank for a refrigerator comprising:

an inner case and an outer case forming one storage space having an opened top by being coupled to each other;

a guide slot formed in one of either the outer side surfaces of the inner case or the inner side surfaces of the outer case in a lengthwise direction; and a guide protrusion formed at the other one and inserted into the guide slot for moving along the guide slot, wherein a plurality of stopping protrusions are provided at an inner surface of the guide slot along a moving direction of the guide protrusion so as for the guide protrusion to be consecutively stopped thereat.

2. The ice bank of claim 1, wherein the inner case and the outer case are each respectively implemented in a hexahedral shape having the top and one end thereof opened, and each of the opened ends are communicated with each other, and the inner case is inserted into the outer case to be fixed thereto so that the inner case and the outer case can be relatively moved in a lengthwise direction.

3. The ice bank of claim 2, wherein both outer side surfaces and an outer bottom surface of the inner case are adherently coupled to both inner side surfaces and an inner bottom surface of the outer case.

4. The ice bank of claim 1, wherein the stopping protrusions are implemented as an elastic member so as to be selectively pressed according to the moving of the guide protrusion.

5. The ice bank of claim 1, wherein a plurality of stopping recesses are provided in an inner surface of the guide slot so that the stopping protrusion is stopped thereat along the moving direction of the guide protrusion.

6. The ice bank of claim 5, wherein the stopping protrusion is implemented as an elastic member so as to be selectively inserted into the stopping recesses according to the moving of the guide protrusion.

7. The ice bank of claim 2, further comprising:

support flanges inwardly extended from upper ends of both sides of the outer case for supporting the inner case.

8. The ice bank of claim 7, wherein the stopping protrusions are implemented as an elastic member so as to be selectively pressed according to the moving of the guide protrusion.

9. The ice bank of claim 7, wherein a plurality of stopping recesses are provided in an inner surface of the guide slot so that the stopping protrusion is stopped thereat along the moving direction of the guide protrusion.

10. The ice bank of claim 9, wherein the stopping protrusion is implemented as an elastic member so as to be selectively inserted into the stopping recesses according to the moving of the guide protrusion.

11. An ice bank for a refrigerator comprising:

an inner case and an outer case forming one storage space having an opened top by being coupled to each other;

a guide slot formed in one of either outer side surfaces of the inner case or inner side surfaces of the first and second outer cases in a lengthwise direction; and a guide protrusion formed at the other one and inserted into the guide slot for moving along the guide slot, wherein a plurality of stopping protrusions are provided at an inner surface of the guide slot along a moving direction of the guide protrusion so as for the guide protrusion to be consecutively stopped thereat, wherein the outer case comprises first and second outer cases each respectively implemented in a hexahedral shape having a top surface and one end thereof opened, and the inner case is implemented in a hexahedral shape having the top and two corresponding ends thereof opened, and wherein the opened ends of the inner case are inserted into the opened ends of the first and second outer cases, respectively, and coupled to each other to form one storage space.

12. The ice bank of claim 11, wherein both outer side surfaces and an outer bottom surface of the inner case are adherently coupled to both inner side surfaces and an inner bottom surface of each outer case, respectively.

13. The ice bank of claim 11, wherein the stopping protrusions are implemented as an elastic member so as to be selectively pressed according to the moving of the guide protrusion.

14. The ice bank of claim 11, wherein a plurality of stopping recesses are provided in an inner surface of the guide slot so that the stopping protrusion is stopped thereat along the moving direction of the guide protrusion.

15. The ice bank of claim 14, wherein the stopping protrusion is implemented as the elastic member so as to be selectively inserted into the stopping recesses according to the moving of the guide protrusion.

16. The ice bank of claim 11, further comprising:

support flanges inwardly extended from upper ends of both sides of the first and second outer cases for supporting the inner case.

17. The ice bank of claim 16, wherein the stopping protrusions are implemented as an elastic member so as to be selectively pressed according to the moving of the guide protrusion.

18. The ice bank of claim 16, further comprising:

a plurality of stopping recesses are provided in an inner surface of the guide slot so that the stopping protrusion is stopped thereat along the moving direction of the guide protrusion.

19. The ice bank of claim 18, wherein the stopping protrusion is implemented as an elastic member so as to be selectively inserted into the stopping recesses according to the moving of the guide protrusion.

* * * * *